US006237582B1

(12) United States Patent
McPherson

(10) Patent No.: US 6,237,582 B1
(45) Date of Patent: May 29, 2001

(54) ARCHERY BOW WITH BOW STRING COPLANAR WITH THE LONGITUDINAL AXIS OF THE BOW HANDLE

(75) Inventor: Mathew A. McPherson, 19055 Incline Rd., Norwalk, WI (US) 54648

(73) Assignee: Mathew A. McPherson, Norwalk, WI (US)

( * ) Notice: Subject to any disclaimer, the term of this patent is extended or adjusted under 35 U.S.C. 154(b) by 0 days.

(21) Appl. No.: 09/502,917

(22) Filed: Feb. 11, 2000

(51) Int. Cl.[7] ..... F41B 5/10; F41B 5/12
(52) U.S. Cl. ..... 124/25.6; 124/25; 124/900
(58) Field of Search ..... 124/25, 25.6, 900

(56) References Cited

U.S. PATENT DOCUMENTS

| | | | |
|---|---|---|---|
| D. 331,614 | 12/1992 | Martin et al. | D22/107 |
| 3,841,295 | 10/1974 | Hunter . | |
| 3,854,467 | 12/1974 | Hofmeister . | |
| 3,958,551 | 5/1976 | Ketchum . | |
| 3,993,039 | 11/1976 | Groves et al. . | |
| 4,372,285 | 2/1983 | Simonds et al. | 124/90 |
| 4,401,097 | 8/1983 | Simonds et al. . | |
| 4,438,753 | 3/1984 | Simonds . | |
| 4,440,142 | 4/1984 | Simonds . | |
| 4,458,657 | 7/1984 | Stockmar | 124/17 |
| 4,461,267 | 7/1984 | Simonds et al. . | |
| 4,478,203 | 10/1984 | Hayes . | |
| 4,512,326 | 4/1985 | Jarrett . | |
| 4,649,891 | 3/1987 | Bozek | 124/25 |
| 4,660,536 | 4/1987 | McPherson . | |
| 4,693,228 | 9/1987 | Simonds et al. | 124/25 |
| 4,827,894 | 5/1989 | Schallberger | 124/25 |
| 4,838,236 | 6/1989 | Kudlacek . | |
| 4,909,231 | 3/1990 | Larson . | |
| 4,993,399 | 2/1991 | Chattin | 124/25.6 |
| 5,005,554 | 4/1991 | Shepley et al. | 124/24.1 |
| 5,025,771 | 6/1991 | Hanson | 124/25 |
| 5,040,520 | 8/1991 | Nurney | 124/25.6 |
| 5,174,268 | 12/1992 | Martin et al. | 124/25.6 |
| 5,307,787 | 5/1994 | LaBorde et al. | 124/25.6 |
| 5,368,006 | 11/1994 | McPherson | 124/25.6 |
| 5,495,843 | 3/1996 | Larson | 124/25.6 |
| 5,505,185 | 4/1996 | Miller | 124/25.6 |
| 5,515,836 | 5/1996 | Martin et al. | 124/23.1 |
| 5,649,520 | 7/1997 | Bednar | 124/25 |
| 5,678,529 | 10/1997 | Larson | 124/25.6 |
| 5,782,229 | 7/1998 | Evans et al. | 124/25.6 |
| 5,809,982 | 9/1998 | McPherson | 124/25.6 |
| 5,884,614 | 3/1999 | Darlington et al. | 124/25 |
| 5,934,265 | 8/1999 | Darlington | 124/25.6 |

OTHER PUBLICATIONS

Bow & Arrow publication of Apr. 1980.
Bow & Arrow publication Dec. 1975.
Advertising from Allen, The Original Compound Bow, Dec. 1975.
Dynabo (Models M–10 Cheetah & Jim Cox Magnum) Instruction Manual Excerpt, mid–1970's.
KAM–Act "MK–2" Instruction Manual Excerpt, early–1970's.
KAM–Act Instruction Manual Excerpt for Martin Archery, Inc., "New for '74", mid–1970's.
Ben Pearson Archery advertisement.
Hoyt Archery advertisement.
Browning advertisement.

*Primary Examiner*—John A. Ricci
(74) *Attorney, Agent, or Firm*—Vidas, Arrett & Steinkraus

(57) ABSTRACT

An archery bow comprises a handle portion, an upper limb supported by the handle portion and a lower limb supported by the handle portion. A top pulley is rotatably mounted upon the upper limb for rotation about a first axle. The top pulley includes a bow string track. A bottom cam assembly is rotatably mounted upon the lower limb for rotation about a second axle. The bottom cam assembly has a primary string payout track and a secondary string payout track. The pulley track and at least one of the primary string payout track and the secondary string payout track are coplanar. Desirably, the pulley track and the primary string payout track are coplanar.

18 Claims, 9 Drawing Sheets

ARCHERY BOW WITH BOW STRING COPLANAR WITH THE LONGITUDINAL AXIS OF THE BOW HANDLE

BACKGROUND OF THE INVENTION

The compound bow is generally characterized by the presence of one or more leveraging devices, typically on the distal ends of the bows limbs. The leveraging devices are used to generate a mechanical advantage favoring the archer. As a compound bow is drawn, the force required to displace the bowstring increases rapidly to a maximum value, typically prior to reaching the mid-point of the draw cycle. At some point beyond mid-draw, the force required to displace the bow string an additional amount decreases with each additional increment of displacement. As a result, at full draw the archer is only required to exert a fraction of the maximum force that was required to initially draw the bow.

One of the earliest compound bows is described in U.S. Pat. No. 3,486,495 to Allen. Although Allen discloses the use of programmed cams, such cams did not actually appear in the marketplace until the advent of computer numerically controlled (CNC) machinery made them economically feasible to produce and sell.

With the advent of CNC machinery, the state of the art has progressed from circular cam profiles to programmed non-circular profiles that result in the ability to store more energy in the bow and therefore provide more energy to accelerate an arrow to a higher launch velocity.

Improvements in cam design have been accompanied by advances in the design of the cable rigging. Some of the early compound bows had auxiliary intermediate idler pulleys with their anchor cables adjustably fastened to the handle sections of the bows. Typically, such bows had two cam elements each mounted independently and requiring very meticulous adjustments to each to synchronize the action of the two cam elements to achieve optimum performance.

More recent dual cam bows have been rigged such that the anchor cables of one cam were secured to the axle which mounts the opposite cam. This tied the system together and provided a degree of corrective feedback that made it difficult to detect discrepancies in eccentric wheel synchronization.

Unfortunately, however, with the advent of programmed cams that were capable of storing even more energy, the cam synchronization problem reappeared and the problem increased with increases in energy storage capability combined with progressively lower holding weights.

The innovation of the dual feed-out single take-up single cam compound bow, disclosed inter alia, in U.S. Pat. No. 5,368,006 provided a major step forward in the simplification of the compound bow.

The background of compound bow development is well documented in the patents that have been granted in this area and for a deeper understanding of the state of the art one can find additional information in the following patents and the patents which they reference:

| U.S. Pat. No. | Issued To |
|---|---|
| 3,841,295 | Hunter |
| 3,854,467 | Hofmeister |
| 3,958,551 | Ketchum |

-continued

| U.S. Pat. No. | Issued To |
|---|---|
| 4,440,142 | Simonds |
| 4,838,236 | Kudlacek |
| 5,040,520 | Nurney |
| 5,307,787 | LaBorde et al. |
| 5,368,006 | McPherson |
| 5,505,185 | Miller |
| 5,678,529 | Larson |

For the purpose of this disclosure, all U.S. patents and patent applications and all other publications referenced herein are incorporated herein by reference in their entirety.

BRIEF SUMMARY OF THE INVENTION

The present invention is directed in one embodiment to an archery bow comprising a handle portion, an upper limb supported by the handle portion and a lower limb supported by the handle portion. A top pulley is rotatably mounted upon the upper limb for rotation about a first axle. The top pulley includes a pulley track. A bottom cam assembly is rotatably mounted upon the lower limb for rotation about a second axle. The bottom cam assembly has a primary string payout track and a secondary string payout track. The pulley track and at least one of the primary string payout track and the secondary string payout track are coplanar. Desirably, the pulley track and the primary string payout track are coplanar.

The archery bow may further comprise a first cable having a first end portion terminating in a first end anchored to the bottom cam assembly and a second end portion terminating in a second end anchored to the bottom cam assembly. The first end portion is received in the primary string payout track, the second end portion is received in the secondary string payout track. A portion of the first cable is trained about the top pulley and received in the pulley track to form a bow-string section and a return section.

Where the bottom cam assembly further comprises a takeup track, the archery bow may further comprise an anchor cable extending between the upper limb and the bottom cam assembly and received in the take-up track.

The instant invention is also directed to an archery bow having a rotatably mounted pulley with a track and a dual feed-out cam with a larger track and smaller track, wherein the improvement comprises at least one of the larger track and the smaller track being coplanar with a track on the pulley.

In another embodiment, the instant invention is directed to an archery bow comprising a handle portion having a longitudinal axis, an upper limb supported by the handle portion and a lower limb supported by the handle portion. A top pulley is rotatably mounted upon the upper limb for rotation about a first axle. The top pulley includes a pulley track. A bottom cam assembly is rotatably mounted upon the lower limb for rotation about a second axle. The bottom cam assembly has a primary string payout track and a secondary string payout track. A first cable is provided having a first end portion terminating in a first end anchored to the bottom cam assembly and a second end portion terminating in a second end anchored to the bottom cam assembly. The first end portion is received in the primary string payout track and the second end portion is received in the secondary string payout track. A portion of the first cable is trained about the top pulley and received in the pulley track to form a bow-string section and a return section. The bow-string section is parallel to the longitudinal axis of the handle.

BRIEF DESCRIPTION OF THE SEVERAL VIEWS OF THE DRAWING(S)

Figure 4A:
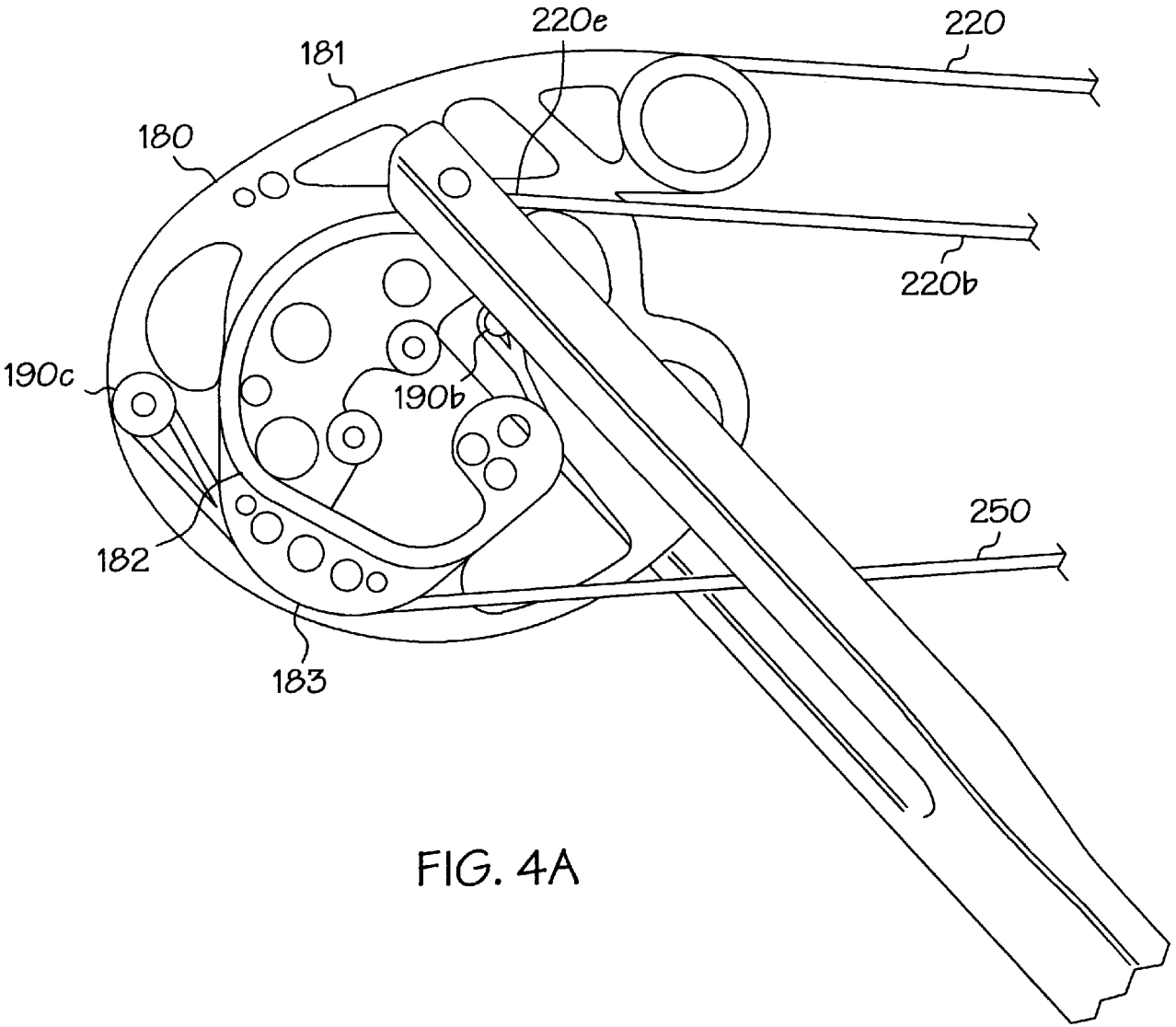
Figure 4B:
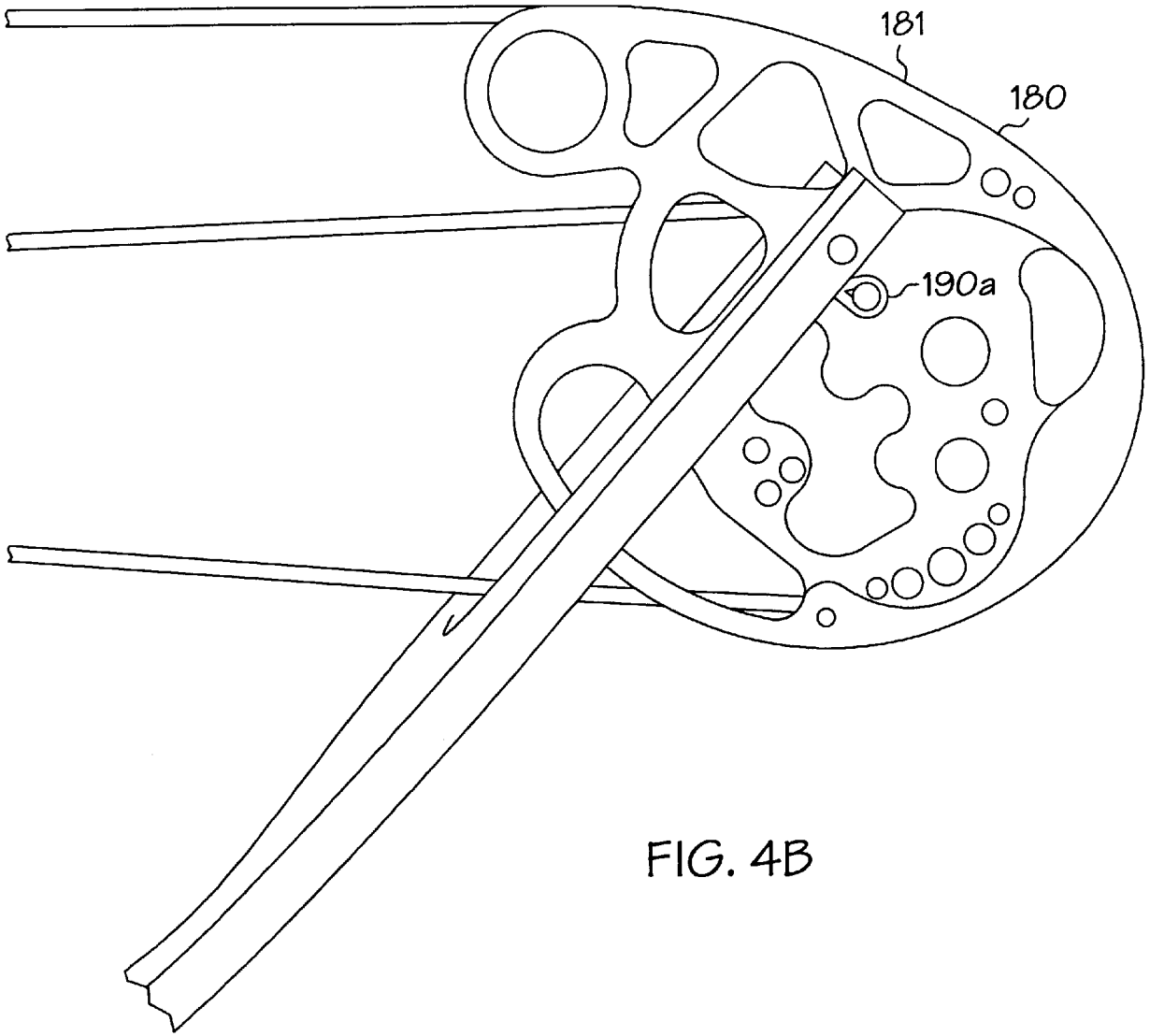

FIGS. 4*a* and 4*b* shows the first and second sides, respectively, of the cam assembly.

Figure 4C:
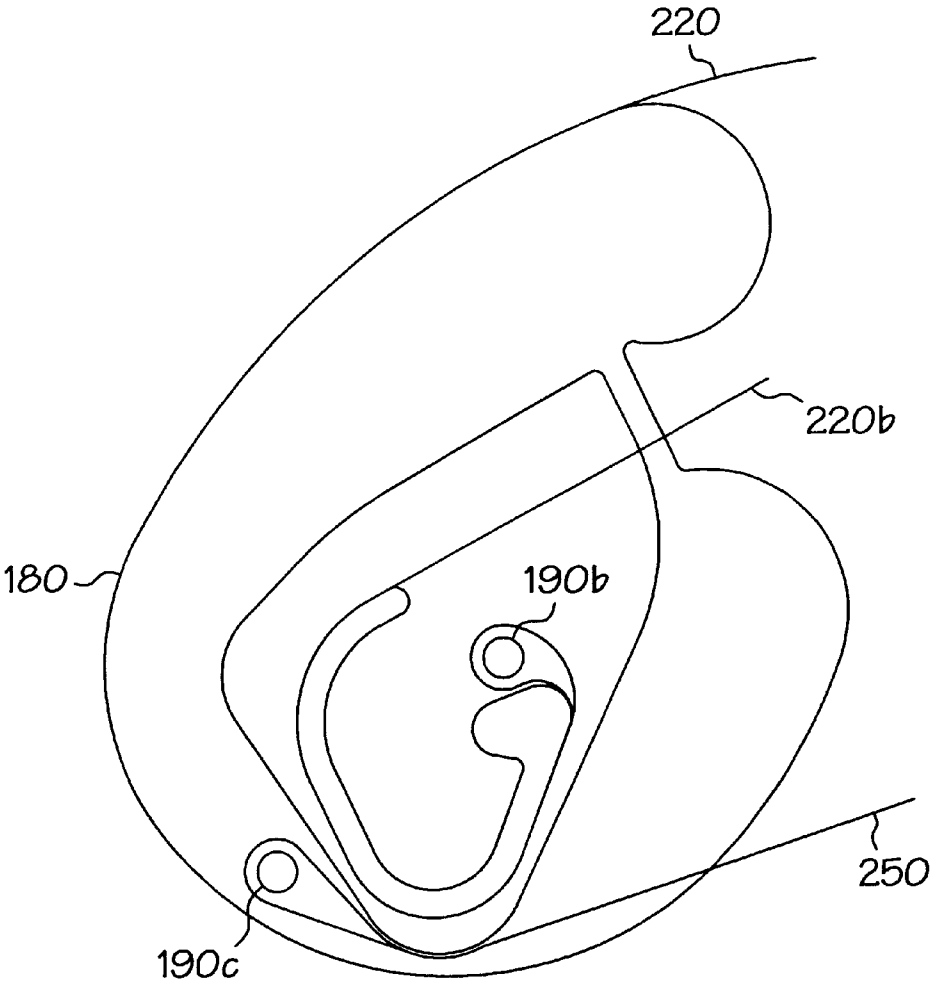

FIG. 4*c* is a schematic drawing of the first side of the cam assembly.

Figure 5:
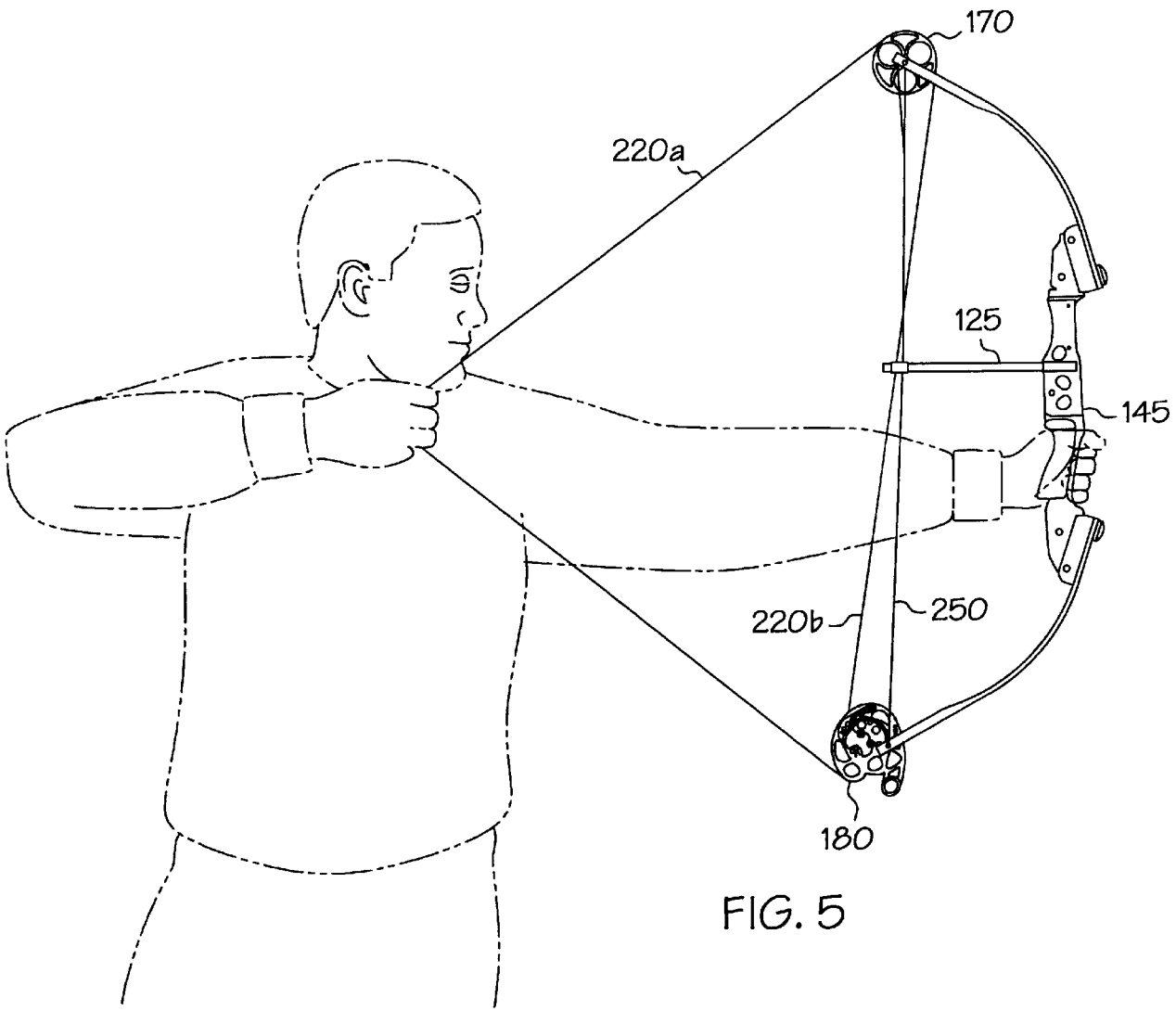

FIG. 5 shows an inventive bow in the drawn position.

Figure 6:
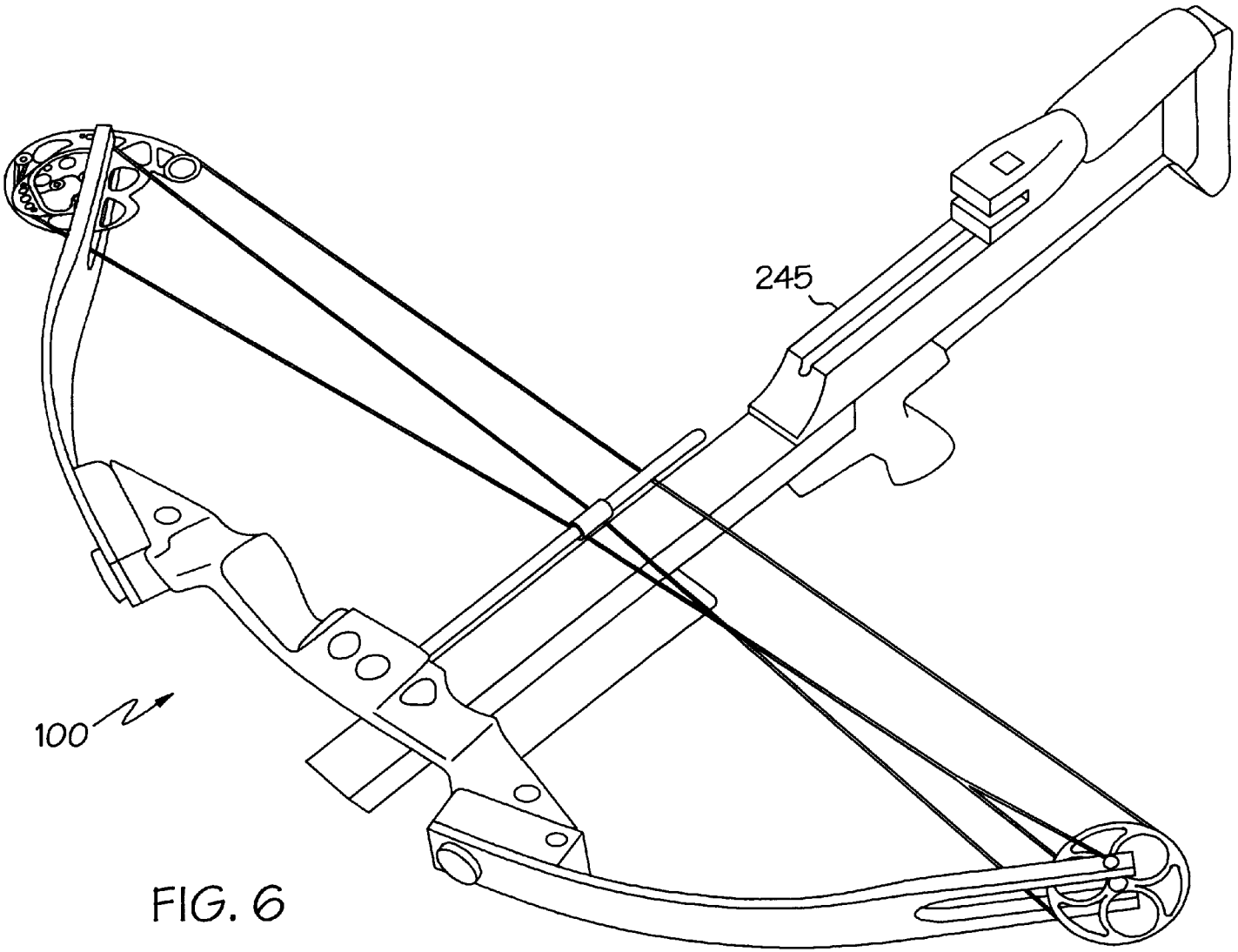

FIG. 6 shows an inventive crossbow.

Figure 7:
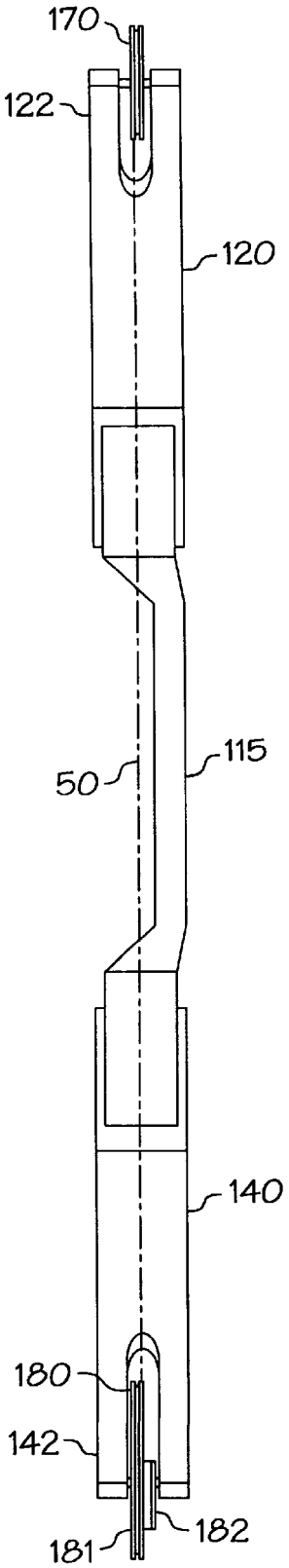

FIG. 7 is a schematic diagram of an inventive archery bow showing a handle with an upper limb offset relative to a lower limb.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

Significant advances have been made in the design of the compound bow, as discussed above. The prior art, however, has failed to recognize the importance of providing a compound bow in which the bow-string extends substantially in the vertical direction. The bow-strings of prior art single cam compound bows tend to be canted at a slight angle and thus deviate slightly from the vertical because the upper pulley and the primary string payout track around which the bow-string is trained are not coplanar. By arranging the upper pulley and the primary string payout track to be coplanar, the bow string will extend substantially in the vertical direction without any deviation therefrom. This in turn, will result in reducing set-up and tuning problems associated with matching the arrow to the bow and increased accuracy in aiming as the bow-string will impart a force which is in the forward direction and in the same plane as the rotating take up elements at the limb tips on either end of the bows limbs.

Figure 1:
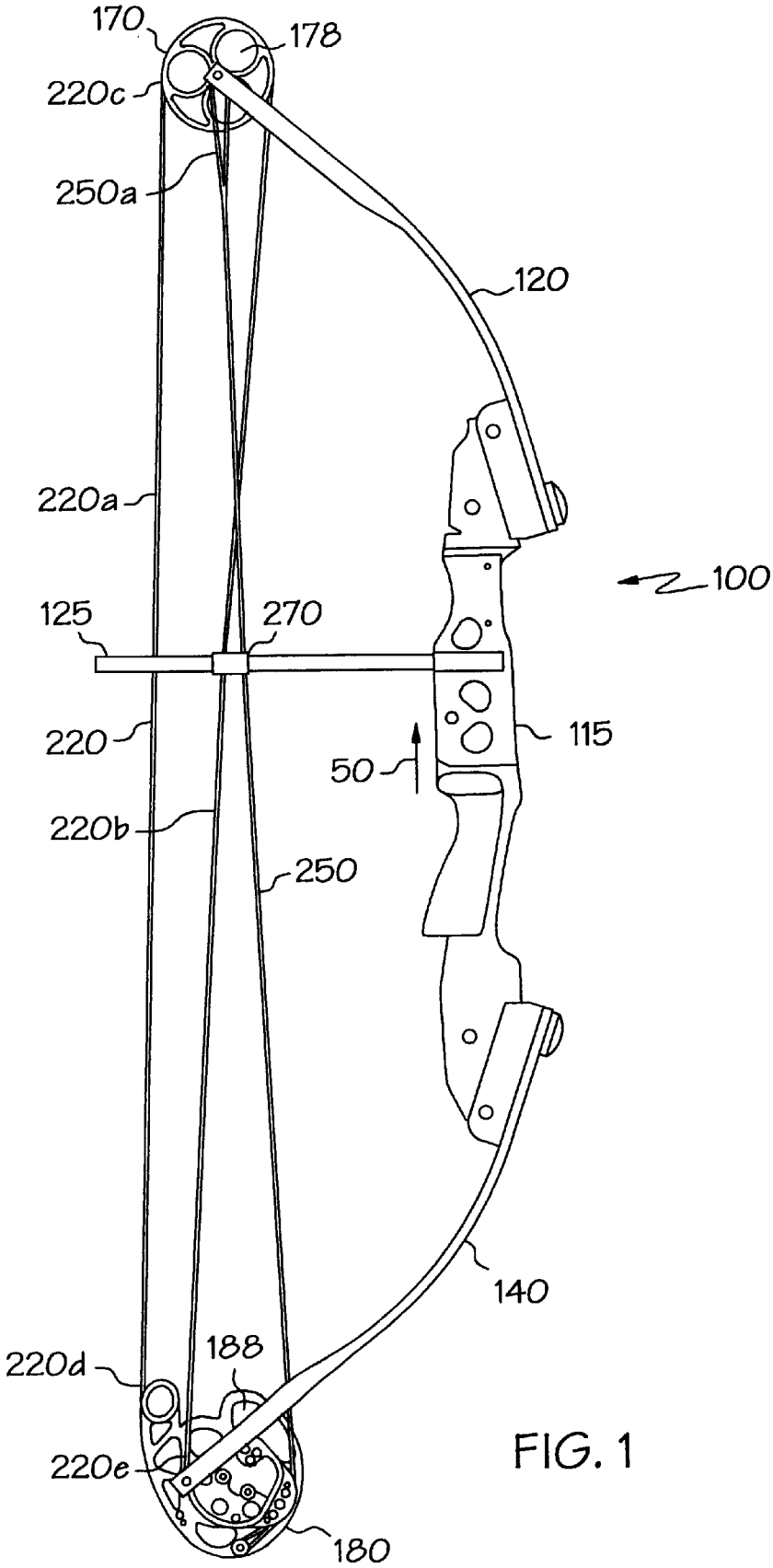
FIG. 1 is a side elevational view of one embodiment of the archery bow structured in accordance with the present invention.

The inventive bow, shown generally at 100 in FIG. 1, in the undrawn state includes a handle portion 115 with an upper flexible limb 120 and a lower flexible limb 140 supported thereon. Handle portion 115, characterized by a longitudinal axis 50, includes an arrow rest 145 (shown in FIG. 5) thereon. The upper and lower limbs 120 and 140 provide the desired resistance to bending which determines the draw weight of the bow and the force with which the arrow (not shown) is discharged.

Figure 2:
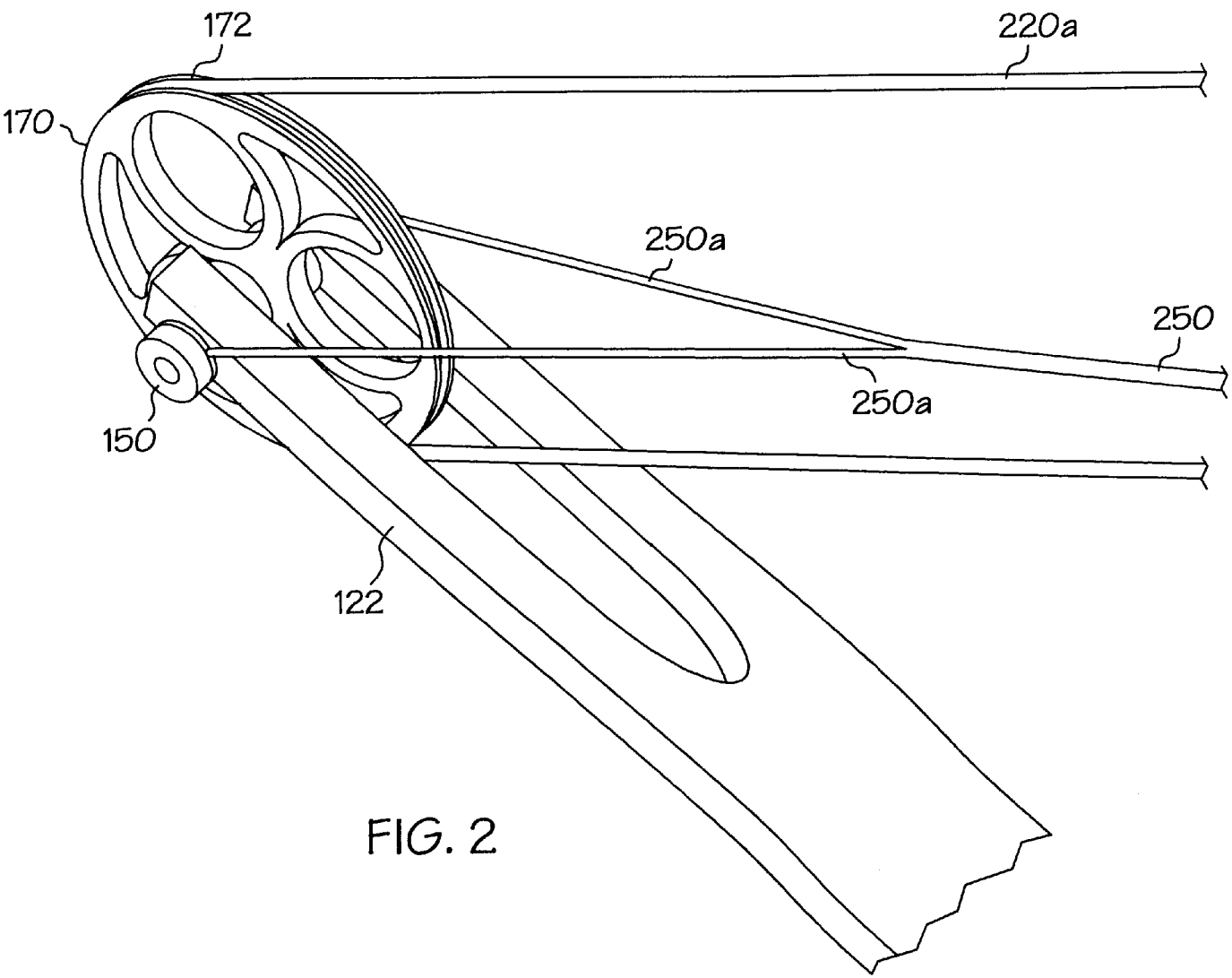
FIG. 2 is a perspective view of the outer end of the upper limb and pulley.
Figure 3:
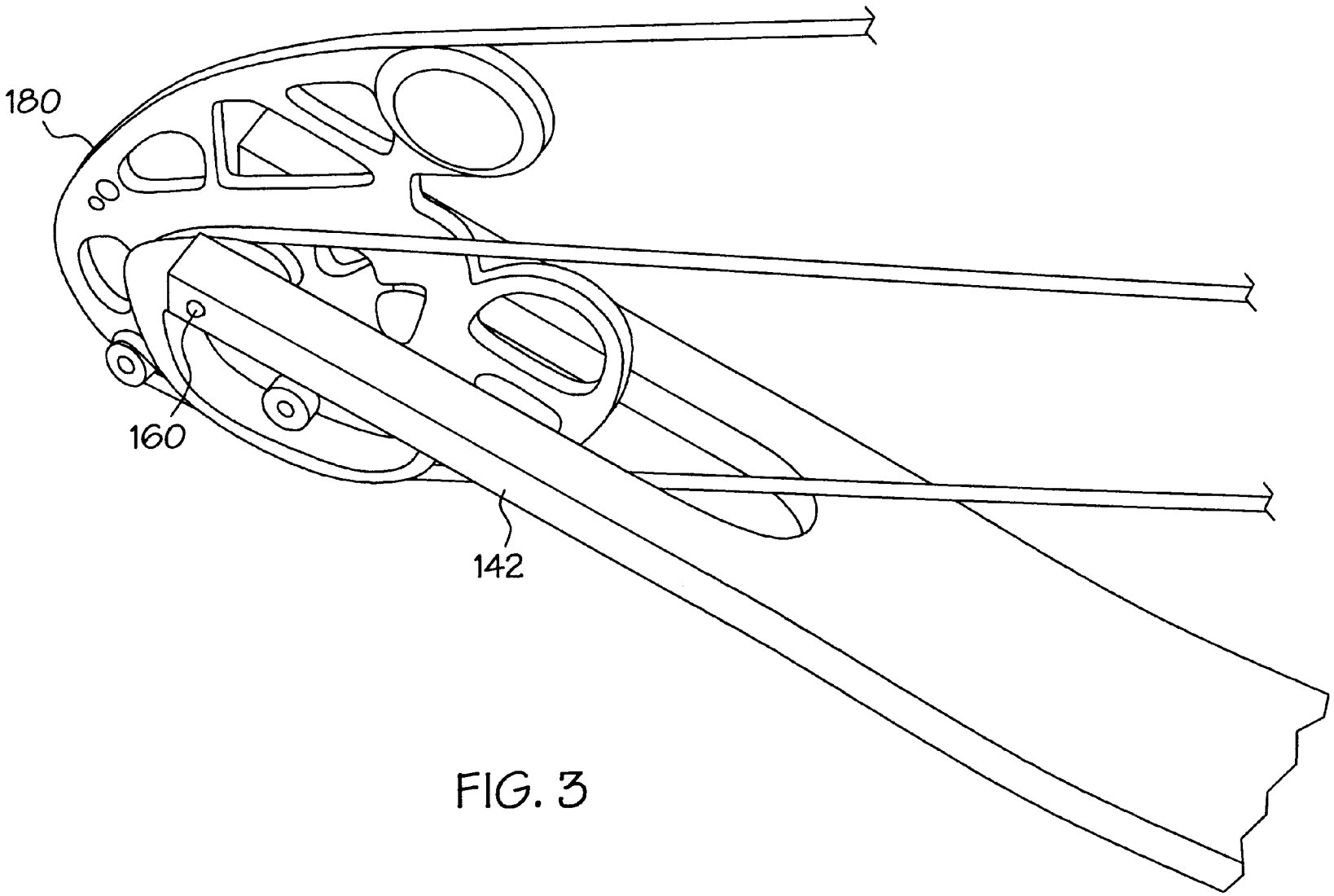
FIG. 3 is a perspective view of the outer end of the lower limb and cam assembly.

As shown in FIGS. 2 and 3, the outer ends of the upper and lower bow limbs provide wheel receiving slots which define wheel mounting forks, respectively designated by the numbers 122 and 142, for mounting axle pins 150 and 160. An idler or pulley 170 is concentrically mounted on axle pin 150 for rotation about axle pin 150. In this form of the invention, pulley 170 is provided with a single groove 172. As shown in FIGS. 4*a* and 4*b*, one form of eccentric cam 180 is mounted on an axle pin 160 for rotation about axle pin 160. In the form shown in FIGS. 4*a* and 4*b*, cam 180 has three eccentrically oriented grooves, 181, 182, and 183 formed in the outer periphery thereof to provide three separate cable groove paths.

Bow 100 further includes a first cable 220 which is trained around top pulley 170 to form bow-string 220*a* and return section 220*b*. Upper section 220*c* of first cable 220 is received in groove 172. The end portions 220*d* and 220*e* of first cable 220 are received in grooves 181 and 182, respectively on bottom cam assembly 180, as shown in FIGS. 4*a* and 4*b*. Groove 181, includes a primary string pay-out track portion. The pay-out portion, that portion of groove 181 which contacts first cable 220 at any point during use of the bow, allows for pay-out of additional cable to section 220*a* as section 220*a* of cable 220 is drawn out. Groove 182 includes a secondary string pay-out track portion. The secondary string pay-out track portion, that portion of groove 182 which contacts first cable 220 at any point during use of the bow, allows for pay-out of additional cable to section 220*b* as section 220*a* of cable 220 is drawn out. The ends of the section 220*d* and 220*e* of section 220*a* and 220*b* are anchored to bottom cam assembly 180 by cable anchor pins 190*a* and 190*b* fixed to cam 180 as shown in FIGS. 4*a–c*.

First cable 220 functions as a bow string.

As best shown in FIGS. 2 and 3, an anchor cable 250 is anchored at one forked end 250*a* to axle pin 150 and at the other end passes around cam groove 183 on the take-up side of cam 180. Cam groove 183 includes a take-up track portion to take up excess anchor cable 250 as the bow is drawn and the upper and lower limbs 120 and 140 draw nearer to one another. The take-up portion is that portion of groove 183 which contacts anchor cable 250 at any point during use of the bow. The other end 250*b* of cable 250, is attached to anchor pin 190*c* as shown in FIGS. 4*a* and 4*c* and positively ties the two bow limbs 120 and 140 together to form a direct connection between the limbs 120 and 140.

Bow 100 further includes guide 125 extending from handle portion 115. Return section 220*b* and anchor cable 250 are slidably coupled to guide via coupler 270.

As shown in FIG. 5, as bow-string 220*a* is drawn, a length of first cable 220 is unwound from groove 172 about pulley 170 and pulley 170 rotates about its axis. Moreover, cam 180 rotates about its axis and additional bow-string 220*a* is unwound from groove 181. As bow-string 220*a* is unwound, additional length of return section 220*b* is unwound from groove 182. Simultaneously, bow limbs 120 and 140 are drawn toward one another and a portion of anchor cable 250 is wound around cam groove 183 storing energy in limbs 120 and 140.

Bow-string 220*a*, as shown in FIG. 1, is parallel to the longitudinal axis of grip portion 115 of the handle. The invention also contemplates embodiments in which the longitudinal axis of the grip portion of the handle is skewed and not parallel to the bow-string.

Top pulley 170 is shown in the figures as having a plurality of openings 178 therethrough which reduce the weight of the pulley assembly. The openings may be differently shaped and/or arranged. The pulley may optionally have additional or fewer openings therethrough or may be of solid construction. A reduced weight pulley having recessed portions rather than openings extending therethrough may also be used.

Similarly, bottom cam assembly 180 is shown in the figures as having a plurality of openings 188 therethrough which reduce the weight of the bottom cam assembly. The openings may be differently shaped and/or arranged. The bottom cam may optionally have additional or fewer openings therethrough or may be of solid construction. A reduced weight bottom cam having recessed portions rather than openings extending therethrough may also be used. Bottom cam assembly 180, as further seen in the figures, may also have an optional weighted disk 230. Details of the weighted disk may be found in U.S. Pat. No. 5,809,982 and U.S. Pat. No. 5,996,567.

Any of the above embodiments may also be configured for use as a crossbow, as shown in FIG. 6. Crossbow 100 shown in FIG. 6 is similar to that shown in FIGS. 1–5 differing in that it further comprises stock 245 which includes a trigger and bow string release member as known in the art. The stock and limbs may be of one piece construction or otherwise permanently joined together or may be disassembled into separate pieces.

Additional details concerning the construction of crossbows may be found in U.S. Pat. No. 5,025,771 and U.S. Pat. No. 4,827,894.

More generally, the present invention is directed to an archery bow comprising a handle portion, an upper limb supported by the handle portion and a lower limb supported by the handle portion. A top pulley is rotatably mounted upon the upper limb for rotation about a first axle. The top pulley includes a pulley track. A bottom cam assembly is rotatably mounted upon the lower limb for rotation about a second axle. The bottom cam assembly has a primary string payout track and a secondary string payout track. The pulley track and at least one of the primary string payout track and the secondary string payout track are coplanar. Desirably, the pulley track and the primary string payout track are coplanar. Optionally, the primary string payout track and the pulley track may be vertically aligned.

The pulley track and the primary string payout track may be made coplanar by horizontally offsetting upper limb 120 of a standard dual cam bow sufficiently relative to lower limb 140 so as to align the pulley track and primary string payout track, as shown schematically in FIG. 7. In so doing, upper forked portion 122 is horizontally offset from lower forked portion 142. The pulley track and the primary string payout track may also be made coplanar via the use of spacers in mounting each of the elements in its respective wheel receiving slots.

The archery bow may optionally further comprise a first cable having a first end portion terminating in a first end anchored to the bottom cam assembly and a second end portion terminating in a second end anchored to the bottom cam assembly. The first end portion is received in the primary string payout track, the second end portion is received in the secondary string payout track. A portion of the first cable is trained about the top pulley and received in the pulley track to form a bow-string section and a return section. Desirably, the longitudinal axis of the handle portion will be parallel to the bow-string section in the vertical plane that contains the arrow's flight path.

In one embodiment, the inventive archery bow has a guide extending from the handle and is characterized in that the bow-string section is perpendicular to the guide in the brace condition of the bow when viewed from a point that is 90 degrees to the arrow's flight path.

Where the bottom cam assembly optionally further comprises a takeup track, the archery bow may further comprise an anchor cable extending between the upper limb and the bottom cam assembly and received in the take-up track.

The instant invention is also directed to an archery bow such as that shown in FIG. 1, having a rotatably mounted pulley 170 with a track and a dual feed-out cam 180 with a larger track 181 and smaller track 182, wherein the improvement comprises at least one of the larger track and the smaller track being coplanar. Desirably, the pulley track and the larger track are coplanar.

In another embodiment, the instant invention is directed to an archery bow comprising a handle portion having a longitudinal axis, an upper limb supported by the handle portion and a lower limb supported by the handle portion. A top pulley is rotatably mounted upon the upper limb for rotation about a first axle. The top pulley includes a pulley track. A bottom cam assembly is rotatably mounted upon the lower limb for rotation about a second axle. The bottom cam assembly has a primary string payout track and a secondary string payout track. A first cable is provided having a first end portion terminating in a first end anchored to the bottom cam assembly and a second end portion terminating in a second end anchored to the bottom cam assembly. The first end portion is received in the primary string payout track and the second end portion is received in the secondary string payout track. A portion of the first cable is trained about the top pulley and received in the pulley track to form a bow-string section and a return section. The bow-string section is parallel to the longitudinal axis of the handle when viewed in the direction of the arrow's flight path.

Other features which may be combined with the inventive bow are described in the following commonly assigned, cofiled U.S. applications: U.S. application Ser. No. 09/503,013; U.S. application Ser. No. 09/502,152; U.S. application Ser. No. 09/502,354; U.S. application Ser. No. 09/502,149; and U.S. application Ser. No. 09/502,643.

In addition to the specific embodiments claimed below, the invention is also directed to other embodiments having any other possible combination of the dependent features claimed below.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. An archery bow comprising:

a handle portion;

an upper limb supported by the handle portion;

a lower limb supported by the handle portion;

a top pulley rotatably mounted upon the upper limb for rotation about a first axle, the top pulley including a pulley track; and a bottom cam assembly rotatably mounted upon the lower limb for rotation about a second axle, the bottom cam assembly having a primary string payout track and a secondary string payout track;

wherein the pulley track and at least one of the primary string payout track and the secondary string payout track are coplanar.

2. The archery bow of claim 1 wherein the primary string payout track and the pulley track are coplanar.

3. The archery bow of claim 2 further comprising a first cable having a first end portion terminating in a first end anchored to the bottom cam assembly and a second end portion terminating in a second end anchored to the bottom cam assembly, the first end portion received in the primary string payout track, the second end portion received in the secondary string payout track, a portion of the first cable trained about the top pulley and received in the pulley track to form a bow-string section and a return section.

4. The archery bow of claim 3 wherein the handle portion has a longitudinal axis and the bow-string section is parallel to the longitudinal axis of the handle.

5. The archery bow of claim 3, the upper limb terminating in an upper forked portion and the lower limb terminating in a lower forked portion wherein the upper forked portion is horizontally offset relative to the lower forked portion.

6. The archery bow of claim 3 having a guide extending from the handle, wherein the bow-string section is perpendicular to the guide when the bow is in a brace position.

7. The archery bow of claim 2 wherein the bottom cam assembly further comprises a takeup track.

8. The archery bow of claim 7 further comprising a first cable having a first end portion terminating in a first end anchored to the bottom cam assembly and a second end portion terminating in a second end anchored to the bottom cam assembly, the first end portion received in the primary string payout track, the second end portion received in the secondary string payout track, a portion of the first cable trained about the top pulley and received in the pulley track to form a bow-string section and a return section.

9. The archery bow of claim 8 further comprising an anchor cable extending between the upper limb and the bottom cam assembly and received in the take-up track.

10. The archery bow of claim 9 wherein the handle portion has a longitudinal axis and the bow-string section is parallel to the longitudinal axis of the handle.

11. The archery bow of claim 2 wherein the primary string payout track and the pulley track are vertically aligned.

12. The archery bow of claim 2 wherein the upper limb is horizontally offset relative to the lower limb.

13. The archery bow of claim 2 configured for use as a crossbow.

14. The archery bow of claim 13 further comprising:

a first cable having a first end portion terminating in a first end anchored to the bottom cam assembly and a second end portion terminating in a second end anchored to the bottom cam assembly, the first end portion received in the primary string payout track, the second end portion received in the secondary string payout track, a portion of the first cable trained about the top pulley and received in the pulley track to form a bow-string section and a return section; and a bow-string drawing device for drawing the bow-string section of the first cable.

15. The archery bow of claim 2 configured for use as a compound bow.

16. An archery bow comprising:

a handle portion having a longitudinal axis;

an upper limb supported by the handle portion;

a lower limb supported by the handle portion;

a top pulley rotatably mounted upon the upper limb for rotation about a first axle, the top pulley including a bow string track;

a bottom cam assembly rotatably mounted upon the lower limb for rotation about a second axle, the bottom cam assembly having a primary string payout track and a secondary string payout track; and a first cable having a first end portion terminating in a first end anchored to the bottom cam assembly and a second end portion terminating in a second end anchored to the bottom cam assembly, the first end portion received in the primary string payout track, the second end portion received in the secondary string payout track, a portion of the first cable trained about the top pulley and received in the pulley track to form a bow-string section and a return section, wherein the bow-string section is parallel to the longitudinal axis of the handle.

17. The archery bow of claim 16 configured for use as a crossbow.

18. The archery bow of claim 16 configured for use as a compound bow.

* * * * *